United States Patent [19]

Mincer et al.

[11] 4,007,293

[45] Feb. 8, 1977

[54] MECHANICALLY VIABLE DEVELOPER MATERIALS

[75] Inventors: Joseph L. Mincer, Lewisville, Tex.; John M. Pochan, Webster, N.Y.

[73] Assignee: Xerox Corporation, Stamford, Conn.

[22] Filed: Mar. 1, 1976

[21] Appl. No.: 662,641

[52] U.S. Cl. ..... 427/19; 96/1 SD; 252/62.1 P; 428/407

[51] Int. Cl.[2] ..... G03G 13/08; G03G 13/09; G03G 9/10

[58] Field of Search ..... 252/62.1 P; 427/19; 96/1 SD; 428/407

[56] References Cited

UNITED STATES PATENTS

| | | | |
|---|---|---|---|
| 3,533,835 | 10/1970 | Hagenbach et al. | 252/62.1 P |
| 3,811,880 | 5/1974 | Browning | 252/62.1 P |

*Primary Examiner*—James R. Hoffman

[57] ABSTRACT

Improved electrostatographic developer mixtures comprising finely-divided toner particles electrostatically clinging to the surface of carrier particles wherein the carrier particles comprise a core having an outer layer thereon of poly(2-vinyl-pyridine) mixed with polyurethane. The use of said developer mixtures for the development of electrostatic latent images is also described.

24 Claims, No Drawings

MECHANICALLY VIABLE DEVELOPER MATERIALS

BACKGROUND OF THE INVENTION

This invention relates, in general, to electrostatographic imaging systems, and, in particular, to improved developer materials and their uses.

The formation and development of images on the surface of photoconductive materials by electrostatic means is well-known. The basic electrophotographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552, is well-known as "cascade" development. In this method, a developer material comprising relatively large carrier particles having finely-divided toner particles electrostatically clinging to the surface of the carrier particles is conveyed to and rolled or cascaded across the electrostatic latent image bearing surface. The composition of the toner particles is so chosen as to have a triboelectric polarity opposite that of the carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic latent image bearing surface and the toner particles are drawn from the brush to the electrostatic latent image by electrostatic attraction.

Another technique for developing electrostatic latent image is the "touchdown" process as disclosed, for example, in U.S. Pat. Nos. 2,895,847 and 3,245,823 to Mayo. In this method, a developer material is carried to a latent image bearing surface by a support layer such as a web or sheet and is deposited thereon in conformity with said image.

Carrier particles are made from or coated with materials having appropriate triboelectric properties as well as certain other physical characteristics. Thus, the materials employed as the carrier particles or the coatings thereon should have a triboelectric value commensurate with the triboelectric value of the toner to enable electrostatic adhesion of the toner to the carrier particles and subsequent transfer of the toner from the carrier particles to the image on the plate without excessive power requirements. Furthermore, the triboelectric properties of all the carrier particles should be relatively uniform to permit uniform pick-up and subsequent deposition of toner. The materials employed in the carrier particles should have an intermediate hardness so as not to scratch the plate or drum surface upon which the electrostatic image is initially placed while being sufficiently hard to withstand the forces to which they are subjected during recycle. The carrier particles as well as the surface thereof also should not be comprised of materials which are so brittle as to cause either flaking of the surface or particle break-up under the forces exerted on the particles during recycle. The flaking causes undesirable effects in that the relatively small flaked particles will eventually be transferred to the copy surface thereby interfering with the deposited toner and causing imperfections in the copy image. Furthermore, flaking of the carrier particle surface will cause the resultant carrier particles to have non-uniform triboelectric properties when the carrier particle is composed of a core material different from the surface coating thereon. This results in undesirable nonuniform pick-up of toner by the carrier particles and non-uniform deposition of toner on the image. In addition, when the carrier particle size is reduced, the removal of the resultant small particles from the plate becomes increasingly difficult. Thus, the type of materials useful for making carrier particles or for coating carrier particles, although having the appropriate triboelectric properties, are limited because other physical properties which they possess may cause the undesirable results discussed above.

It is highly desirable to alter the triboelectric properties of carrier cores to accommodate the use of desirable toner compositions while retaining the other desirable physical characteristics of the carrier particle. The alteration of the triboelectric properties of carrier particles by applying a surface coating thereon is a particularly desirable technique. With this technique, not only is it possible to alter the triboelectric properties of carrier particles made from materials having desirable physical characteristics, it is also possible to employ materials previously not suitable as carrier particles. Thus, for example, carrier particles having desirable physical properties with the exception of hardness, can be coated with a material having desirable hardness as well as other physical properties, rendering the resultant product useful as carrier particles.

While ordinarily capable of producing good quality images, conventional developing materials suffer serious deficiencies in certain areas. The developing materials must flow freely to facilitate accurate metering and even distribution during the development and developer recycling phases of the electrostatographic process. Some developer materials, though possessing desirable properties such as proper triboelectric characteristics, are unsuitable because they tend to cake, bridge and agglomerate during handling and storage. Adherence of carrier particles to reusable electrostatographic imaging surfaces causes the formation of undesirable scratches on the surfaces during image transfer and surface cleaning steps. The tendency of carrier particles to adhere to imaging surfaces is aggravated when the carrier surfaces are rough and irregular. The coatings of most carrier particles deteriorate rapidly when employed in continuous processes which require the recycling of carrier particles by bucket conveyors partially submerged in the developer supply such as disclosed in U.S. Pat. No. 3,099,943. Deterioration occurs when portions of or the entire coating separates from the carrier core. The separation may be in the form of chips, flakes or entire layers and is primarily caused by fragile, poorly adhering coating materials which fail upon impact and abrasive contact with machine parts and other carrier particles. Carriers having coatings which tend to chip and otherwise separate from the carrier core must be frequently replaced thereby increasing expense and loss of productive time. Print deletion and poor print quality occur when carrier particles having damaged coatings are not replaced. Fines and grit formed from carrier disintegration tend to drift and form undesirable and damaging deposits on critical machine parts. Many carrier coatings having high compressive and tensile strength either do not adhere well to the carrier core or do not possess the desired triboelectric characteristics. The triboelectric and flow characteristics of many carriers are adversely affected when relative humidity is high. For example, the triboelectric values of some carrier coatings fluctuate with changes in relative humidity and are not desirable for employment in electrostatographic systems, particularly in automatic machines which require carriers having stable and predictable triboelectric values. Another factor affecting the stability of carrier triboelectric properties is the susceptibility of carrier coatings to "toner impaction". When carrier particles are employed in automatic machines and recycled through many cycles, the many collisions which occur between the carrier particles and other surfaces in the machine cause the toner particles carried on the surface of the carrier particles to be welded or otherwise forced into the carrier coatings. The gradual accumulation of permanently attached toner material on the surface of the carrier particles causes a change in the triboelectric value of the carrier particles and directly contributes to the degradation of copy quality by eventual destruction of the toner carrying capacity of the carrier. Thus, there is a continuing need for a better material for developing electrostatic latent images.

It is, therefore, an object of this invention to provide developer materials which overcome the above-noted deficiencies and are suitable for use in electrostatographic reproduction processes.

It is another object of this invention to provide carrier particles which possess improved electrostatic and physical properties for efficient and prolonged use in electrostatographic reproduction processes.

It is a further object of this invention to provide carrier particles having an elastic and tough coating which tenaciously adheres to the carrier core whereby the carrier particles are more resistant to toner impaction, chipping and flaking.

It is another object of this invention to provide developer materials which flow more freely.

It is yet another object of this invention to provide carrier materials having more stable triboelectric values.

It is a further object of this invention to provide carrier coatings having higher tensile and compressive strength.

It is yet another object of this invention to provide carrier coatings having greater resistance to disintegration.

It is yet another object of this invention to provide coated carrier materials having greatly increased developer life.

It is still another object of this invention to provide developer materials having physical and chemical properties superior to those of known developer materials.

The above objects and others are accomplished, generally speaking, by providing electrostatographic developer mixtures comprising finely-divided toner particles electrostatically clinging to the surface of carrier particles wherein said carrier particles comprise a core having an outer layer thereon of poly(2-vinyl-pyridine) mixed with polyurethane.

In accordance with this invention, it has been found that mixtures of poly(2-vinyl-pyridine) and polyurethane or poly(2-vinyl-pyridine) with polyurethane and poly(vinylbutyral) provide electrostatographic carrier coating materials which possess desirable triboelectric charging properties and which also possess elastic or viscoelastic properties as to avoid or minimize mechanical degradation of carrier particles coated therewith. It has been generally believed that failure of toner and coated carrier developer mixtures in electrostatographic reproduction devices is at least partially attributed to toner impaction. It has been found that carrier coating materials usually degrade chemically to lower molecular weight species under the repeated stresses of tumbling and recycling in the housing of reproduction machines. This degradation is thought to be aggravated by the high mechanical stress levels created in the machine configuration from carrier-to-carrier, and carrier-to-housing impacts. The degradation of the carrier coating materials results in coating depletion via polymer substrate adhesive failure or polymer failure resulting in undesirably altered carrier coating triboelectric charging characteristics.

It is postulated that the molecular weight changes of the polymer carrier coating materials may be due to the inability of the carrier coating material to store mechanical energy during the numerous aforementioned impacts. Another theory is that prior carrier coating materials are unable to extend under applied mechanical stress and thus fracture due to brittleness and chain scission of the polymer coating occurs. According to this invention, carrier coating materials have been found which substantially eliminate such effects by possessing elastic mechanical properties which allow for deformation and recovery during and following mechanical impact.

It has now been found that the properties desired of carrier coating materials may be attained by solution blending poly(2-vinyl-pyridine) and polyurethane or poly(2-vinyl-pyridine) with polyurethane and polyvinylbutyral. Poly(2-vinyl-pyridine) is the component of the mixtures that provides desirable triboelectric charging properties to the carrier coating materials, while the polyurethane provides the carrier coating materials with tensile strength, modulus, elongation properties, tear strength, and abrasion resistance. These blended systems not only have desirable mechanical properties, but also exhibit low work functions on the triboelectric scale. The polyurethane employed as a component of the carrier coating materials of this invention generally has a tensile strength of between about 5300 psi and about 5700 psi; a tensile modulus of between about 700 psi and about 1700 psi; elongation of between about 300 percent and about 500 percent; and a tear strength of between about 300 pounds and about 400 pounds. In addition, the polyurethane component preferably has a molecular weight of less than about 50,000 as it provides for better compatibility with the aforementioned polymer systems.

In accordance with this invention, satisfactory electrostatographic carrier coating compositions are provided when the materials comprise from between about 10 and about 90 parts by weight of poly(2-vinyl-pyridine) and from between about 90 and about 10 parts by weight of polyurethane. However, it is preferred that the electrostatographic carrier coating compositions of this invention comprise from between about 30 and about 70 parts by weight of poly(2-vinyl-pyridine) and from between about 70 and about 30 parts by weight of polyurethane because these mixtures exhibit good mechanical properties and stable cascade triboelectric charge values. Further, the extremes of composition, particularly of poly(2-vinyl-pyridine) provide for excessive sensitivity to high relative humidities. Optimum results are generally obtained when the electrostatographic carrier coating compositions of this invention comprise from between about 40 and about 60 parts by weight of poly(2-vinyl-pyridine) and from between about 60 and about 40 parts by weight of polyurethane. In addition, mixtures of polyurethane, polyvinylbutyral, and poly(2-vinyl-pyridine) may be employed to obtain the electrostatographic carrier coating compositions of this invention and such mixtures are considered within the scope of this invention. When poly(vinyl-butyral) is employed in the coating compositions of this invention, it may be present in an amount of from between about 5 and about 20 parts by weight based on the total parts of the coating composition.

Ordinarily, the desired blending of two polymers would lead to a solution of one polymer in another. However, few polymer systems exhibit this behavior and generally experience gross phase separation morphology when observed with optical microscopy. When preparing the blended polymer systems of this invention, this problem may be overcome by dissolving the polyurethane and poly(2-vinyl-pyridine) in equal concentrations in tetrahydrofuran and chloroform, respectively. These solutions may then be blended in desired amounts and evaporated. Microscopic examination of dried films of the polymer blend shows little or no phase separation indicating that polymer domain size was at all times less than 2 microns throughout the range of polymer blend concentrations.

In cascade triboelectric charge measurements, it was found that phase separated morphology of the polymer blends of this invention has only a slight effect on the triboelectric characteristics of the mixtures with the more finely-dispersed polymer systems tending toward a linear triboelectric relationship with composition. It was also found that the polymer blend systems of this invention containing up to about 30.0 percent by weight of poly(2-vinyl-pyridine) are relatively insensitive to relative humidity and other ambient conditions while providing the polymer blend the capability of generating high triboelectric charging of toner material. As to the mechanical properties of the polymer blends of this invention, polyurethane exhibits maximum elastomeric behavior and a low modulus with high elongation properties in the absence of poly(2-vinyl-pyridine). It was further found that the tensile modulus as a function of polymer blend composition exhibits a maximum at about 75.0 percent by weight of poly(2-vinyl-pyridine). However, the polymer blends of this invention all exhibit large elongations to break and high moduli at poly(2-vinyl-pyridine) percentages greater than 5.0. Generally speaking, the mechanical properties of the polymer blends show modulus decreasing and elongation to break increasing with increased polyurethane content.

In general, the electrostatographic coated carriers of the present invention may be prepared by coating a solid substrate with a mixture of poly(2-vinyl-pyridine) and polyurethane or poly(2-vinyl-pyridine) with polyurethane and poly(vinylbutyral) and hardening the resulting layer to form a hard substantially continuous coating thereon. Any suitable coating technique may be used to apply the coating to the substrate such as spraying, dipping, or fluidized bed coating. Any suitable coating thickness may be employed. However, a coating having a thickness at least sufficient to form a thin continuous film is preferred because the carrier coating will then possess sufficient thickness to resist abrasion and prevent pinholes which adversely affect the triboelectric properties of the coated carrier. Generally, for cascade and magnetic brush development, the carrier coating may comprise from about 0.1 percent to about 1.0 percent by weight based on the weight of the coated carrier particle. Preferably, the coating should comprise from about 0.2 percent to about 0.7 percent by weight based on the weight of the coated carrier particle because maximum coating durability, toner impaction resistance, and copy quality are achieved.

Any suitable well-known coated or uncoated carrier material may be employed as the substrate for the carriers of this invention. Typical carrier core materials include sodium chloride, ammonium chloride, aluminum potassium chloride, Rochelle salt, sodium nitrate, potassium chlorate, granular zircon, granular silicon, methyl methacrylate, glass, silicon dioxide, flintshot, iron, steel, ferrite, nickel carborundum and mixtures thereof. Typical carrier substrates for "touchdown" donor surfaces include cloth, metal-backed paper, cellophane, aluminum foil, resins such as polyethylene terephthalate and polyvinyl resins, cellulosic derivatives, protein materials, and combinations thereof. Many of the foregoing and other typical carrier materials are described by L. E. Walkup in U.S. Pat. No. 2,618,551; L. E. Walkup et al in U.S. Pat. No.

2,638,416; E. N. Wise in U.S. Pat. No. 2,618,552; and C. R. Mayo in U.S. Pat. Nos. 2,805,847 and 3,245,823. An ultimate coated carrier particle having an average diameter between about 30 microns to about 1,000 microns is preferred in cascade systems because the carrier particle then possesses sufficient density and inertia to avoid adherence to the electrostatic images during the cascade development process. Adherence of carrier beads to an electrostatographic drum is undesirable because of the formation of deep scratches on the drum surface during the image transfer and drum cleaning steps, particularly where cleaning is accomplished by a web cleaner such as the web disclosed by W. P. Graff, Jr. et al, in U.S. Pat. No. 3,186,838.

Any suitable finely-divided toner material may be employed with the coated carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, epoxy resins, polyester resins, polyethylene resins and mixtures thereof. The particular toner material to be employed obviously depends upon the separation of the toner particles from the coated carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson and U.S. Pat. No. 2,788,288 to Rheinfrank et al. These toners generally have an average particle diameter between about 1 and about 30 microns.

Any suitable pigment or dye may be employed as the colorant for the toner particles. Toner colorants are well known and include, for example, carbon black, nigrosine dye, aniline blue, Calco Oil Blue, chrome yellow, ultra marine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable conventional toner concentration may be employed with the coated carriers of this invention. Typical toner concentrations include about 1 part toner with about 10 to 200 parts by weight of carrier.

Any suitable well-known electrophotosensitive material may be employed as the photoreceptor with the coated carriers of this invention. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The surprisingly better results obtained with the carrier coating materials of this invention may be due to many factors. For example, the marked durability of the coating materials may be due to the fact that these resins provide improved abrasion resistance with the substrates tested. Greatly improved adhesion over conventional coating materials is obtained when the coating materials of this invention are applied to glass, steel or similar metallic particles. Coatings prepared from the polymer blends of this invention possess smooth outer surfaces which are highly resistant to cracking, chipping, and flaking. The smooth tough surface enhances the rolling action of the carrier particles across the electrostatographic surfaces and reduces the tendency of the carrier particles to adhere to the electrostatographic surfaces. The carrier coatings are easily prepared and exhibit improved stability during extended periods of usage. The carrier coatings employed in the present invention are non-tacky and have sufficient hardness at normal operating temperatures to prevent impaction; form strong adhesive coatings which do not flake under normal operating conditions; and have triboelectric values such that they can be used with a wide variety of presently available toners in present electrostatographic processes. Thus, the coated carrier particles of this invention have desirable properties which permit their wide use in presently available electrostatographic processes.

The carrier coating materials of this invention are further characterized by low apparent contact potentials and thus enhance the triboelectric charging properties of toner materials. When used as electrostatographic carrier coatings, these polymer blends provide coatings having excellent durability due to their mechanical properties and are especially desirable when employed in continuous electrostatographic development processes which require the recycling of carrier particles by bucket conveyors partially submerged in the developer material supply. Further, these resins have good heat and chemical resistance which is also desirable when employed as carrier coatings in the presence of various conventional electroscopic toner materials and at the conditions encountered in electrostatographic machines.

DESCRIPTION OF PREFERRED EMBODIMENTS

The following examples, other than the control examples, further define, describe and compare preferred methods of utilizing the coated carriers of the present invention in electrostatographic applications. Parts and percentages are by weight unless otherwise indicated.

In the following, the relative triboelectric values generated by contact of carrier beads with toner particles is measured by means of a cascade device. The device comprises a grounded metal plate set at an arbitrary but constant angle of elevation to horizontal, for example, 30°, with a cup at the bottom of the incline. The cup is not attached to the incline and is thus not grounded; but it is attached to an electrometer. The material to be tested is coated onto a metallic sheet, such as aluminum, and this is attached to the incline. Then beads of the desired carrier material are cascaded down the film and into the electrometer cup, where the charge acquired by the beads is measured. From this quantity and the weight of the beads the charge to mass ratio is calculated. This quantity is a direct measure of the triboelectric charging capacity of the polymeric film. The measurement is done at constant relative humidity and temperature. Since triboelectric measurements are relative, the measurements should, for comparative purposes, be conducted under substantially identical conditions.

EXAMPLE I

Cascade triboelectric charging measurements were performed according to the aforementioned procedure on a series of polymer blends as indicated in Table I. Films of the polymer blends were cast onto aluminum sheets from a solution of tetrahydrofuran and chloroform. The films were vacuum dried for about one hour and then tested immediately in an atmosphere of about 70° F and relative humidity of about 60.0 percent. Nominal 250 micron steel carrier particles were similarly dried for about 24 hours in vacuo at about 135° F. Cascade triboelectric measurements were conducted using the grounded metal plate set at an angle of 30°. The steel carrier particles were cascaded over the various film compositions over a 9 inch distance from a drop height of about 2 centimeters to the surface of the samples. Though both carrier beads and films may be affected by moisture, the slope of a line at a given relative humidity is a function only of the materials since the same carrier is used for each film. The results shown in Table I indicate a practical means of predicting the relative triboelectric charging behavior of poly(2-vinyl-pyridine) (available from Polysciences, Inc., Rydal, Pa.) and polyurethane (5701 Estane, available from B. F. Goodrich Chemical Company, Cleveland, Ohio) polymer blends such as predictably increasing the negative triboelectric charging property thereof.

TABLE I

Cascade Triboelectric Measurements on Poly(2-Vinyl-Pyridine) (PVP) and Polyurethane (Pu) Polymer Mixtures

| Composition | | |
|---|---|---|
| % PVP | % Pu | Nano-Coulombs/Gram Carrier |
| 0 | 100 | −0.39 |
| 1 | 99 | −2.85 |
| 5 | 95 | −3.9 |
| 10 | 90 | −4.8 |
| 30 | 70 | −8.0 |
| 50 | 50 | −9.5 |
| 70 | 30 | −11.5 |
| 90 | 10 | −11.7 |
| 95 | 5 | −11.7 |
| 99 | 1 | −12.5 |
| 100 | 0 | −12.2 |

Although specific materials and conditions were set forth in the above examples for making and using the developer materials of this invention, these are merely intended as illustration of the present invention. Various other toners, carrier cores, substituents and processes such as those listed above may be substituted for those in the examples with similar results.

Other modifications of the present invention will occur to those skilled in the art upon a reading of the present disclosure. These are intended to be included within the scope of this invention.

What is claimed is:

1. A carrier particle for electrostatographic developer mixtures, said carrier particle having an average particle diameter from between about 30 microns and about 1,000 microns, said carrier particle comprising a core having an outer coating, said outer coating comprising a mixture of poly(2-vinyl-pyridine) and polyurethane.

2. A carrier particle for electrostatographic developer mixtures in accordance with claim 1 wherein said outer coating comprises from between about 90 percent and about 10 percent by weight of polyurethane and from between about 10 percent and about 90 percent by weight of poly(2-vinyl-pyridine), based on the weight of said outer coating.

3. A carrier particle for electrostatographic developer mixtures in accordance with claim 1 wherein said outer coating comprises from between about 70 percent and about 30 percent by weight of polyurethane and from between about 30 percent and about 70 percent by weight of poly(2-vinyl-pyridine), based on the weight of said outer coating.

4. A carrier particle for electrostatographic developer mixtures in accordance with claim 1 wherein said outer coating comprises from between about 60 percent and about 40 percent by weight of polyurethane and from between about 40 percent and about 60 percent by weight of poly(2-vinyl-pyridine), based on the weight of said outer coating.

5. A carrier particle for electrostatographic developer mixtures in accordance with claim 1 wherein said polyurethane has a tensile strength of between 5300 psi and about 5700 psi, a tensile modulus of between about 700 psi and about 1700 psi, elongation of between about 300 percent and about 500 percent, and a tear strength of between about 300 pounds and about 400 pounds.

6. A carrier particle for electrostatographic developer mixtures in accordance with claim 1 wherein said polyurethane has a molecular weight of less than about 50,000.

7. A carrier particles for electrostatographic developer mixtures in accordance with claim 1 wherein said outer coating comprises from about 0.1 percent to about 1.0 percent by weight based on the weight of said carrier particle.

8. A carrier particle for electrostatographic developer mixtures in accordance with claim 1 wherein said outer coating contains from between about 5 and about 20 percent by weight of poly(vinylbutyral) based on the weight of said outer coating.

9. An electrostatographic developer mixture comprising finely-divided toner particles electrostatically clinging to the surface of carrier particles, said carrier particles having an average diameter from between about 30 microns and about 1,000 microns, said carrier particles comprising a core having an outer coating, said outer coating comprising a mixture of poly(2-vinyl-pyridine) and polyurethane.

10. An electrostatographic developer mixture in accordance with claim 9 wherein said outer coating comprises from between about 90 percent and about 10 percent by weight of polyurethane and from between about 10 percent and about 90 percent by weight of poly(2-vinyl-pyridine), based on the weight of said outer coating.

11. An electrostatographic developer mixture in accordance with claim 9 wherein said outer coating comprises from between about 70 percent and about 30 percent by weight of polyurethane and from between about 30 percent and about 70 percent by weight of poly(2-vinyl-pyridine), based on the weight of said outer coating.

12. An electrostatographic developer mixture in accordance with claim 9 wherein said outer coating comprises from between about 60 percent and about 40 percent by weight of polyurethane and from between about 40 percent and about 60 percent by weight of poly(2-vinyl-pyridine), based on the weight of said outer coating.

13. An electrostatographic developer mixture in accordance with claim 9 wherein said polyurethane has a tensile strength of between 5300 psi and about 5700 psi, a tensile modulus of between about 700 psi and about 1700 psi, elongation of between about 300 percent and about 500 percent, and a tear strength of between about 300 pounds and about 400 pounds.

14. An electrostatographic developer mixture in accordance with claim 9 wherein said polyurethane has a molecular weight of less than about 50,000.

15. An electrostatographic developer mixture in accordance with claim 9 wherein said outer coating comprises from about 0.1 percent to about 1.0 percent by weight based on the weight of said carrier particles.

16. An electrostatographic developer mixture in accordance with claim 9 wherein said outer coating contains from between about 5 and about 20 percent by weight of poly(vinylbutyral) based on the weight of said outer coating.

17. An electrostatographic imaging process comprising the steps of forming an electrostatic latent image on a recording surface and developing said latent image by contacting said recording surface with a developer mixture comprising finely-divided toner particles electrostatically clinging to the surface of carrier particles, said carrier particles having an average diameter from between about 30 microns and about 1,000 microns, said carrier particles comprising a core having an outer coating, said outer coating comprising a mixture of poly(2-vinyl-pyridine) and polyurethane, whereby at least a portion of said finely-divided toner particles are attracted to and deposited on said recording surface in conformance with said electrostatic latent image.

18. An electrostatographic imaging process in accordance with claim 17 wherein said outer coating comprises from between about 90 percent and about 10 percent by weight of polyurethane and from between about 10 percent and about 90 percent by weight of poly(2-vinyl-pyridine), based on the weight of said outer coating.

19. An electrostatographic imaging process in accordance with claim 17 wherein said outer coating comprises from between about 70 percent and about 30 percent by weight of polyurethane and from between about 30 percent and about 70 percent by weight of poly(2-vinyl-pyridine), based on the weight of said outer coating.

20. An electrostatographic imaging process in accordance with claim 17 wherein said outer coating comprises from between about 60 percent and about 40 percent by weight of polyurethane and from between about 40 percent and about 60 percent by weight of poly(2-vinyl-pyridine), based on the weight of said outer coating.

21. An electrostatographic imaging process in accordance with claim 17 wherein said polyurethane has a tensile strength of between 5300 psi and about 5700 psi, a tensile modulus of between about 700 psi and about 1700 psi, elongation of between about 300 percent and about 500 percent, and a tear strength of between about 300 pounds and about 400 pounds.

22. An electrostatographic imaging process in accordance with claim 17 wherein said polyurethane has a molecular weight of less than about 50,000.

23. An electrostatographic imaging process in accordance with claim 17 wherein said outer coating comprises from about 0.1 percent to about 1.0 percent by weight based on the weight of said carrier particles.

24. An electrostatographic imaging process in accordance with claim 17 wherein said outer coating contains from between about 5 and about 20 percent by weight of poly(vinylbutyral) based on the weight of said outer coating.

* * * * *